US007828587B2

(12) United States Patent
Hermant et al.

(10) Patent No.: US 7,828,587 B2
(45) Date of Patent: Nov. 9, 2010

(54) POWER MICROCONNECTOR

(75) Inventors: Stéphane Hermant, Etampes sur Marne (FR); Gilles Rouchaud, Montmirail (FR)

(73) Assignee: Axon'Cable, Montmirail (FR)

( * ) Notice: Subject to any disclaimer, the term of this patent is extended or adjusted under 35 U.S.C. 154(b) by 49 days.

(21) Appl. No.: 12/300,974

(22) PCT Filed: May 16, 2007

(86) PCT No.: PCT/FR2007/051288

§ 371 (c)(1), (2), (4) Date: Nov. 14, 2008

(87) PCT Pub. No.: WO2007/135324

PCT Pub. Date: Nov. 29, 2007

(65) Prior Publication Data

US 2009/0186511 A1 Jul. 23, 2009

(30) Foreign Application Priority Data

May 18, 2006 (FR) ..... 06 51806

(51) Int. Cl.
*H01R 12/24* (2006.01)

(52) U.S. Cl. ..... 439/495

(58) Field of Classification Search ..... 439/495, 439/496, 67, 362
See application file for complete search history.

(56) References Cited

U.S. PATENT DOCUMENTS

| | | | | |
|---|---|---|---|---|
| 4,737,118 | A | 4/1988 | Lockard | |
| 5,259,780 | A | 11/1993 | Morrissey, III et al. | |
| 5,816,845 | A | 10/1998 | Chishima et al. | |
| 6,520,791 | B2 * | 2/2003 | Burger | 439/362 |
| 2003/0013341 | A1 * | 1/2003 | Urbaniak et al. | 439/496 |

FOREIGN PATENT DOCUMENTS

| | | | |
|---|---|---|---|
| EP | 0 280 449 | A2 | 8/1988 |
| EP | 1 089 386 | A1 | 4/2001 |
| FR | 2 600 827 | A1 | 12/1987 |
| GB | 1 280 477 | A | 7/1972 |

* cited by examiner

*Primary Examiner*—Phuong K Dinh
(74) *Attorney, Agent, or Firm*—Kenyon & Kenyon LLP

(57) ABSTRACT

Electrical connector for supplying electronic circuits with current. The connector comprises a flat metal bar and an insulating case comprising an open cavity extended by an inclined support covered by an end portion of the bar.

11 Claims, 2 Drawing Sheets

FIG.1
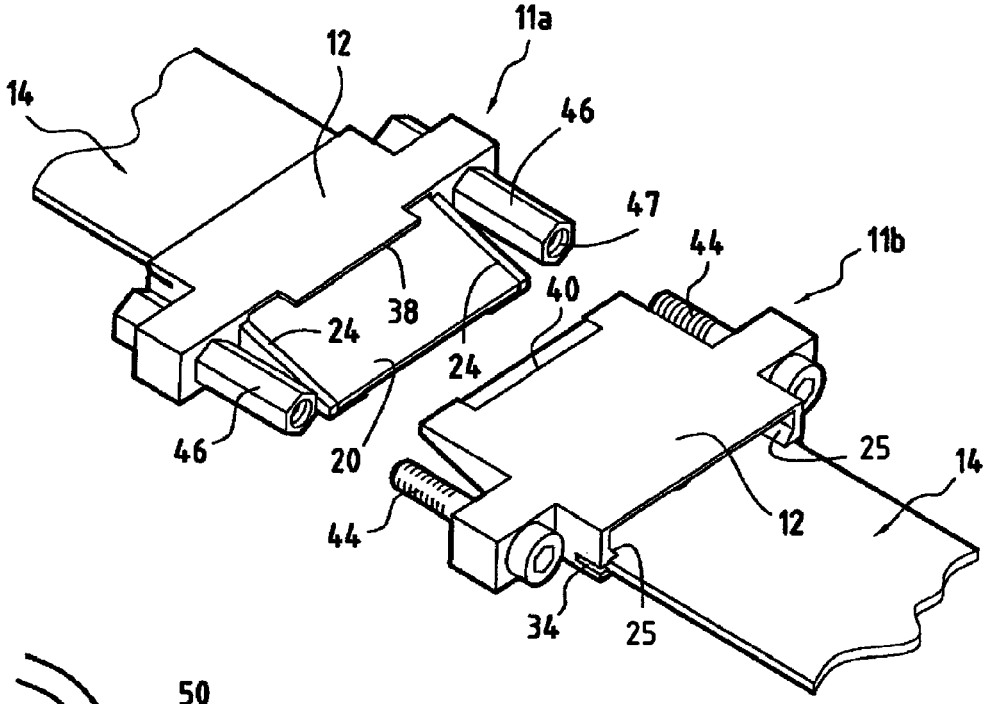
FIG.5
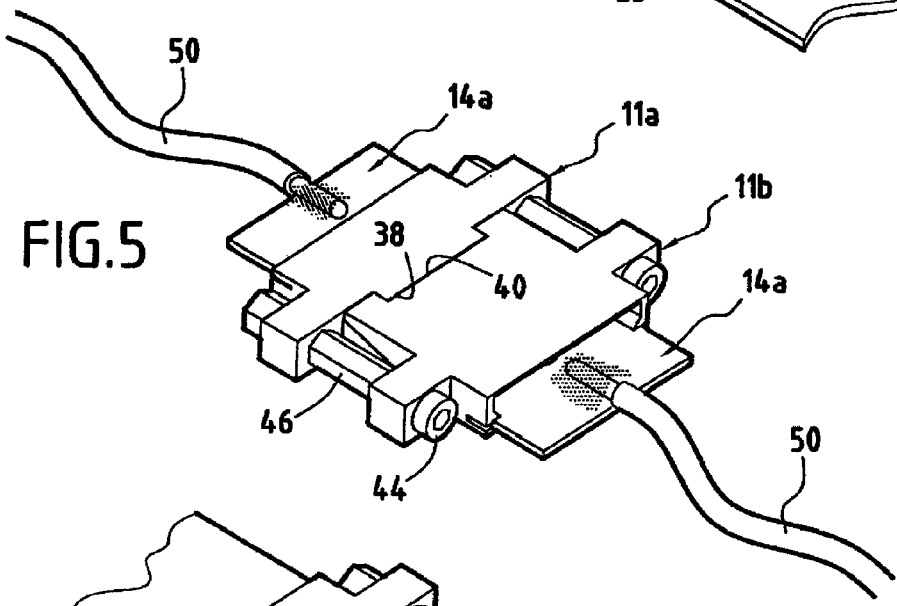
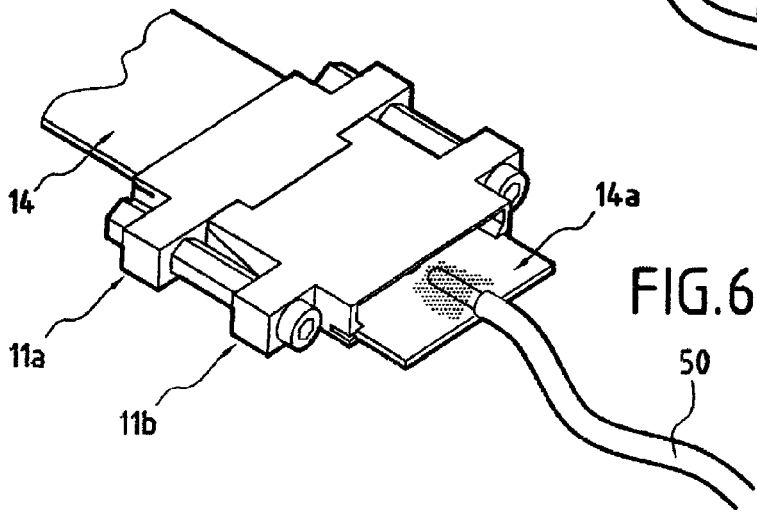
FIG.6

POWER MICROCONNECTOR

This is a 371 national phase application of PCT/FR2007/051288 filed 16 May 2007, which claims priority to French Patent Application No. FR 0651806 filed 18 May 2006, the contents of which are incorporated herein by reference.

FIELD OF THE INVENTION

The invention relates to a new type of electrical connector, more particularly suited to connecting power links in an electronic system, for supplying the different circuits or subassemblies with current. It also relates to an electrical link comprising such a connector and a pair of connectors adapted to each other. The invention is advantageously applicable to the connection of relatively rigid power distribution bars, usually used in such electronic systems.

BACKGROUND OF THE INVENTION

Various systems are known for establishing the electrical current distribution links in and between electronic units.

It is possible, for example, to use terminals crimped onto the ends of wires and linked by screw/nut systems.

Also frequently used are relatively rigid flat metal bars, which need to be connected to each other. It is possible, for example, to link two bars by a screw/nut system.

Finally, it is possible to use power connectors which are easier to dismantle. A power contact crimped to a wire or soldered to a bar is formed to cooperate with a connector, inside which an electrical junction with another contact housed in the case is established, for example under elastic stress.

These connector-based link systems nevertheless present various drawbacks, notably a significant bulk, a high contact resistance value, often rapid wear of these contacts and difficulties in checking the quality of the electrical junction, in situ.

SUMMARY OF THE INVENTION

The invention makes it possible to overcome all these drawbacks.

More particularly, the invention relates to an electrical connector, characterized in that it comprises a flat metal bar and a case made of insulating material comprising an open cavity of a shape and size such that said bar passes through it and extended by an inclined support covered by an end portion of said bar, and means of immobilizing said bar in said case.

The connector defined hereinabove can be connected to another similar conductor, each according to the preceding definition, these connectors being fitted with complementary mechanical assembly means. For example, one of the connectors can be fitted with tapped spacers, or similar, and the other can be fitted with screws that can cooperate with said spacers.

As will be seen below, the case can be structured so that, when two connectors are joined, the assembly forms a block of substantially constant thickness completely surrounding the two end portions, in contact, of the two bars, the joining of the two cases guaranteeing the electrical contact between the two end portions covering the two inclined supports. These end portions overlap as the two connectors are brought together, until the final flat electrical contact. Said end portions can be treated to reduce the contact resistance. For example, the surfaces of these end portions can be silver-plated or gold-plated.

Because of this flat docking arrangement, simultaneously involving the two end portions as a whole, the wear of the metal parts of these connectors required to come into contact is considerably reduced.

According to another advantageous characteristic, the immobilizing means between the case and said metal bar comprise two snap-fitting stops borne by two lateral walls of said case, projecting into said cavity and spaced apart from a transverse face of the latter by a distance corresponding to the thickness of said bar.

Advantageously, said immobilizing means comprise a boss projecting into said cavity and a hole provided in said bar, cooperating with said boss.

Also advantageously, said boss is defined on said transverse face so that the engagement of said boss in said hole is locked by said stops maintaining said bar in the vicinity of said transverse face.

BRIEF DESCRIPTION OF THE DRAWINGS

The invention will be better understood, and other advantages of the latter will become better apparent, in light of the description that follows, given solely by way of example and with reference to the appended drawings in which:

FIG. 1 is a perspective view of a pair of similar and complementary connectors, according to the invention, for linking two current distribution bars, the two connectors being represented before their coupling;

FIG. 5 is a perspective view of a pair of connectors according to the invention, coupled and establishing the link between two cylindrical electrical cables; and FIG. 6 is a perspective view of a pair of connectors according to the invention, coupled, and establishing the link between a cylindrical electrical cable and a power distribution bar.

DETAILED DESCRIPTION

Figure 2:
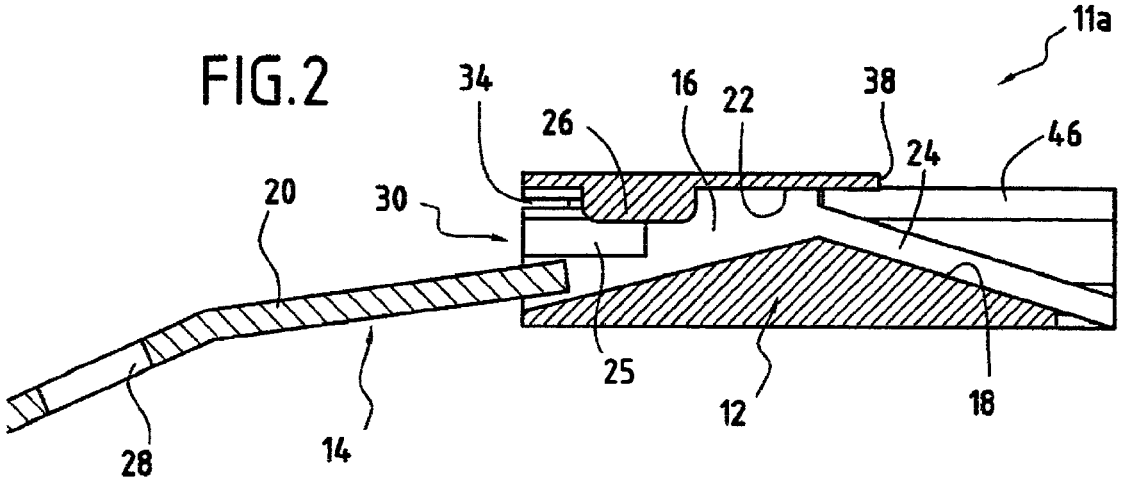
FIGS. 2 to 4 are cross-sectional views of such a connector, illustrating the assembly between the case of insulating material and the metal bar.

Referring more particularly to FIGS. 1 to 4, it can be seen that an electrical connector 11*a* or 11*b* according to the invention mainly comprises a case 12 made of insulating material and a flat metal bar 14. The case comprises an open cavity 16, that is, a cavity that opens out at both its ends, extended by an inclined support 18. The flat metal bar 14 comprises an end portion 20 which is folded relative to the rest of the bar, by an angle corresponding to the angle defined between said inclined support 18 and an internal transverse face 22 of the cavity. The metal bar here has a constant width. Lateral ribs 24 are defined either side of said inclined support and spaced apart by a distance corresponding to the width of the end portion 20 of the bar 14. Said end portion 20 is applied to the inclined support 18, between these two ribs (FIG. 4) when the flat metal bar 14 is engaged in said case 12.

Furthermore, the connector comprises means of immobilizing the bar 14 in the case 12.

In the example described, the immobilizing means notably comprise two snap-fitting stops 25 borne by two opposite laterals walls of said case. These stops project into the cavity 16 and are spaced apart from said transverse face 22 by a distance corresponding to the thickness of said bar 14. Each stop has a triangular profile.

Figure 3:
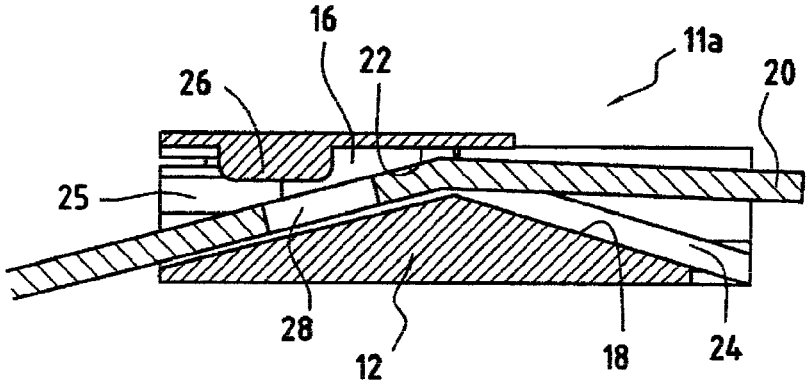
Figure 4:
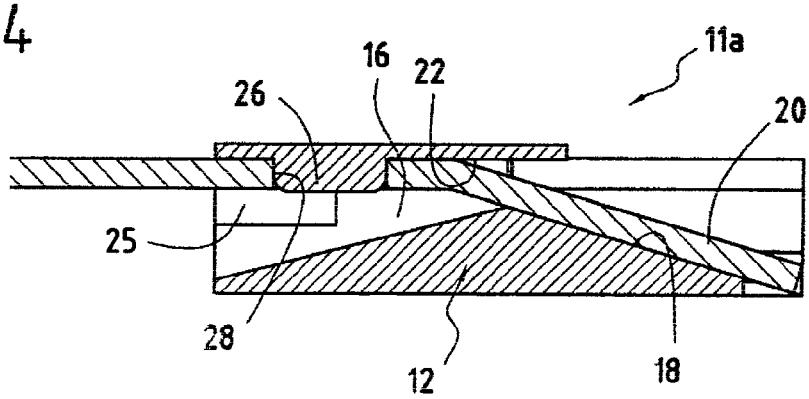

The immobilizing means also comprise a boss 26 projecting into the cavity 22 and a hole 28 provided in said bar, cooperating with said boss 26 to immobilize the flat metal bar in the case, in the longitudinal direction. In the example, this boss is defined on the transverse face 22 and the engagement of the boss in the hole 28 is locked by the stops 25 which maintain the bar in the vicinity of the transverse face 22. FIGS. 2 to 4 show the insertion of the metal bar 14 into the case. The bar is engaged by the open end 30 of the cavity, on the side of the stops (FIG. 2) until said folded end portion 20 exits through the other end, above the inclined support 18 (FIG. 3). The straightening of the flat bar towards the transverse face 22 is reflected in a deformation of the lateral walls bearing said snap-fitting stops 25 when the edges of said bar 14 come into contact with the inclined faces of the stops 25, until said bar arrives in the vicinity of said transverse face 22 and is blocked by the stops, resuming their initial position at the same time as the deformation of the lateral walls disappears. During this movement, said terminal part 20 of the bar is applied against the inclined support 18, between the two ribs 24, whereas the hole 28 of the bar cooperates with the boss 26 (FIG. 4).

Advantageously, the end portion 20 of the bar, at least, may have been subjected to a silver-plating or gold-plating treatment.

The two lateral faces bearing the two stops 25 are also provided with slots 34. Each slot is provided between the transverse face 22 and the corresponding stop 25. These slots facilitate the deformation of the wall when the metal bar is inserted. They also make it possible to define measurement points (for connecting a voltmeter between the two connectors once joined) making it possible to evaluate the quality of the electrical contact obtained after mechanically joining the two connectors. The flat bar 14 can in effect be covered with an insulating material outside the case; it is therefore sufficient to strip the edges of the bar in the vicinity of these slots 34 to enable a measuring instrument to be electrically connected.

Each connector comprises a transverse tab 38 in the vicinity of the exit from the cavity on the side of the inclined support and a cutout 40 of shape and dimensions corresponding to the end of this same inclined support. Thus, when two similar connectors as illustrated in FIG. 1 are offered up to one another but inverted relative to one another, the tab 38 of one engages in the cutout 40 of the other, either side of the contact zones, as can be seen by comparing FIGS. 1 and 5, for example. A functional play is provided between the tab 38 and the cutout 40 for the contact between the two end portions 20 of the two bars to be assured.

Furthermore, the two connectors of FIG. 1 are similar but not completely identical. One is fitted with screws 44 situated laterally either side of the bar whereas the other is fitted with spacers 46 provided with tapped holes 47, fixed to the case, either side of its contact zone. The spacing between the screws corresponds to the spacing between the spacers and the engagement of the screws in the spacers makes it possible to definitively immobilize the connectors in the extension of one another in a position such that the two end portions 20 of the two bars come into contact with each other, flat. The contact is obtained at the end of travel over all of the facing surfaces and with virtually no friction. The longevity of the end portions 20 is greatly increased.

The invention also relates to an electrical link comprising a conductor associated with an electrical connector in accordance with the above description.

In the embodiment illustrated in FIG. 1, each connector 11*a* or 11*b* is combined with the conductor with which it is associated since said conductor and the metal bar are one and the same piece. In other words, it is the end of the flat conductor forming a relatively rigid power distribution bar, which is formed and possibly machined or treated to be directly introduced into a case 12 made of insulating material. The example of FIG. 1 therefore corresponds to the connection of two distribution bars, end-to-end.

In the example of FIG. 5, on the other hand, each connector comprises only a short flat metal bar 14*a* projecting a few millimeters beyond the opening 30 and to which is soldered a conventional, cylindrical electrical wire 50, provided with an insulating sheet. The conductor wire is soldered to the metal bar in the vicinity of the case.

In the example of FIG. 6, one of the connectors is associated with a flat distribution bar whereas the other is linked to a conductive electrical wire 50 as in the example of FIG. 5.

The invention claimed is:

1. An electrical connector comprising a flat metal bar and a case made of insulating material comprising an open cavity through which said bar passes and extended by an inclined support covered by an end portion of said bar, forming contact, and a mechanism to immobilize said bar in said case, wherein said immobilizing mechanism comprises two snap-fitting stops borne by two lateral walls of said case, projecting into said cavity and spaced apart from a transverse face of the latter, by a distance corresponding to the thickness of said bar.

2. The connector as claimed in claim 1, wherein said immobilizing mechanism comprises a boss projecting into said cavity and a hole provided in said bar, cooperating with said boss.

3. The connector as claimed in claim 2, wherein said boss is defined on said transverse face and the engagement of said boss in said hole is locked by said stops maintaining said bar in the vicinity of said transverse face.

4. The connector as claimed in claim 1, wherein said end portion of said bar is folded relative to the rest of this bar, by an angle corresponding to the angle defined between said transverse face and said inclined support.

5. The connector as claimed in claim 1, wherein lateral ribs are defined on either side of said inclined support and spaced apart by a distance corresponding to the width of said end portion of said bar.

6. The connector as claimed in claim 5, wherein said end portion is gold-plated or silver-plated.

7. An electrical link, comprising a conductor associated with an electrical connector as claimed in claim 1.

8. The electrical link as claimed in claim 7, wherein said conductor and said metal bar are one and the same piece.

9. The electrical link as claimed in claim 7, wherein an electrical conductor wire is connected, for example soldered, to said metal bar, in the vicinity of said case.

10. A pair of connectors, comprising two similar connectors, each as claimed in claim 1, fitted with a complementary mechanical assembly mechanism.

11. The pair of connectors as claimed in claim 10, wherein one is fitted with screws and the other is fitted with tapped spacers or similar.

* * * * *